United States Patent [19]

Foster, Jr. et al.

[11] Patent Number: 4,878,415

[45] Date of Patent: Nov. 7, 1989

[54] BOMB PALLET DESIGN WITH HYDRAULIC DAMPING AND FIRE SUPPRESSANT

[75] Inventors: Joseph C. Foster, Jr., Ft. Walton Beach; Andrew G. Bilek, Valparasio, both of Fla.

[73] Assignee: The United States of America as represented by the Secretary of the Air Force, Washington, D.C.

[21] Appl. No.: 234,064

[22] Filed: Aug. 18, 1988

[51] Int. Cl.[4] ..... F42B 57/00; F42B 39/00; B65D 81/08; B65D 85/30

[52] U.S. Cl. ..... 89/34; 206/3

[58] Field of Search ..... 89/34, 40.07; 206/3, 206/443; 220/20, 426, 428

[56] References Cited

U.S. PATENT DOCUMENTS

| | | | |
|---|---|---|---|
| 2,420,663 | 5/1947 | Heath et al. | 220/428 |
| 2,928,530 | 3/1960 | Sauey | 206/3 |
| 3,603,107 | 9/1971 | Elliott et al. | 62/459 |
| 3,731,585 | 5/1973 | Demberg et al. | 206/3 |
| 3,757,933 | 9/1973 | Banta | 206/3 |
| 4,222,484 | 9/1980 | Howe | 206/3 |
| 4,248,342 | 2/1981 | King et al. | 206/3 |
| 4,257,520 | 3/1981 | Hohmann et al. | 206/3 |
| 4,286,708 | 9/1981 | Porzel | 206/3 |
| 4,440,296 | 4/1984 | Howe et al. | 206/3 |
| 4,562,765 | 1/1986 | Grunewald et al. | 89/34 |

FOREIGN PATENT DOCUMENTS

| | | | |
|---|---|---|---|
| 1121621 | 7/1968 | United Kingdom | 206/3 |
| 1213138 | 11/1970 | United Kingdom | 206/3 |

*Primary Examiner*—David H. Brown

*Attorney, Agent, or Firm*—WIlliam G. Auton; Donald J. Singer

[57] ABSTRACT

The presention of sympathetic detonations between donor and acceptor bombs, which are stored lying horizontally parallel to each other, is accomplished by storing these bombs on a bomb storage pallet with a plurality of enclosed tubes which extend along the length of the bombs, and which are filled with fire suppressant chemical extinguishing agents. Additionally, shielding is provided to the stored bombs with diverters which block fragments in the event of a detonation, and which have a sufficient width to attenuate propagating shock to a level below a threshold at which sympathetic detonation occurs. The bomb pallet assembly has a horizontal base to which a frame is fixed. This frame holds the diverters in place and can have enclosed tubes of fire quenching agents within its structure, including its outer walls. Additionally the diverters each have a central aperture to hold similar enclosed tubes of fire quenching agents.

8 Claims, 2 Drawing Sheets

BOMB PALLET DESIGN WITH HYDRAULIC DAMPING AND FIRE SUPPRESSANT

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to explosive containment devices for stored explosives, and specifically to a bomb pallet design with fire extinguishing chemical agents encased within the structural elements of the pallet for the suppression of sympathetic detonation between groups of bombs.

The safe storage of insensitive high explosive (IHE) general purpose bombs is of concern to the U.S. Air Force. These large ordinance items include the MK-80 series of bombs, which are loaded with tritonal. It is the current practice to store these large ordinance items in close proximity with each other in confined storage areas. When this practice is used, it is important to divert and suppress the effect of an initially exploding donor bomb from its adjacent neighbors (acceptor bombs).

An analysis of the detonation of MK-82 bombs has identified no less than four mechanical processes which transport energy from the donor bomb to the acceptor bomb for sympathetic detonation. These processes are identified as (a) flyer plate mode, (b) pure shock transmission, (c) mechanical distortion, and (d) fragment penetration. The primary difference between (a) and (d) is the distance between the items. While air is not an efficient medium for shock propagation, it does allow large energy transfers by means of the flyer plate mode.

Tests have shown that the high local pressures produced by donor bombs are effective in heaving and displacing the adjacent bombs to considerable distances and at fairly high and unaccepatable velocities. Also, large quantities of high explosive material may be exposed and is capable of sustaining fires. For confined storage areas when groups of bombs are stored on pallets, both the sympathetic detonation problem and fire and high bomb displacement problem must be addressed. A detonating bomb (donor bomb) not only produces high pressures and high velocity fragments but the detonation of a donor bomb is associated with a release of a considerable amount of heat; thus, posing a fire problem. Should a bomb adjacent to the detonating donor bomb be ruptured exposing the explosive fill to the intense thermal pulse accompanying the detonation, the exposed high explosive will ignite thereby supporting long duration thermal loading which may ignite other explosives in or out of a ruptured case. Since most explosive fills will burn readily being oxygen rich, a possible sequence of explosions of a number of bombs lying close together in a confined area is possible. The present need is to improve the storage of individual high explosives. The present invention is intended to satisfy that need.

SUMMARY OF THE INVENTION

The present invention includes a bomb pallet for preventing or greatly reducing the effects of a detonating bomb stored adjacent to a group of bombs in an open or confined storage area. Chemical extinguishing agents are incorporated (encased) in the structural elements of the pallet. When one bomb detonates, the action of free radical quenching agents, typically $NaHCO_3$, sodium bicarbonate, water and halon type vapcring liquid agents are driven into the expanding gas field of the detonation. When this occurs, the generation of steam and evolution of carbon dioxide dilutes the oxygen and changes the chemical composition of the original gas field, thereby slowing the gas velocity so as to reduce the pressure on adjacent bombs and reduce the velocity of any bomb fragments.

The spreading of the agents also reduces the temperature of any exposed explosive to a point where combustible vapors are no longer evolved. The net result is that any fire hazard from a detonated bomb is significantly reduced.

In one embodiment of the invention, the bomb pallet design is in the structural form of a buffer diverter, system in which a buffer is placed between adjacent bombs. The buffer is composed of acrylic plastic (lucite) with glass or boron fibers used to enhance the mechanical properties of the plastic. This buffer has a thickness which is selected to attenuate the shock of a donor bomb down to a level below the threshold level required to induce sympathetic detonation in an adjacent donor bomb. The result is a buffer diverter system between bombs lying side by side that reduces the effect of shock and pressure waves and retards the velocity of fragments from an exploding bomb, and which chemically extinguishes and reduces the flames produced by detonating donor bombs.

It is a principal object of the present invention to prevent sympathetic detonation between high explosive bombs when they are stored horizontally lying side by side.

It is another object of the present invention to retard the velocity of case fragments from a donor bomb in protection of an acceptor bomb, and to reduce the flames produced by a donor bomb.

It is a final object of the present invention to enhance the safety of the storage of munitions and other explosive devices.

These together with other objects, features and advantages of the invention will become more readily apparent from the following detailed description wherein like elements are given like reference numerals throughout.

DETAILED DESCRIPTION OF THE PREFERRED EMBODIMENT

The present invention is a bomb pallet system which contains chemical extinguishing agents to suppress sympathetic detonation between high explosive bombs when they are stored lying horizontally side by side. The prevention of sympathetic detonation between a donor bomb and acceptor bomb is accomplished through the use of extinguishing agents, and through the pallet design which interpose a buffer between adjacent stored bombs. The buffer has a width with sufficient thickness to attenuate the shock of an exploding bomb down below a threshold level required to ignite adjacent bombs. The buffer also has a sufficient height to shield the silhouette of an acceptor bomb from adjacent donor bombs. Finally, both the buffer and the pallet frame contain hollow centers which form enclosed tubes filled with fire suppressant chemical extinguishing agents. These enclosed tubes run the length of the stored bombs and suppress sympathetic detonations in the manner described above.

Figure 1:
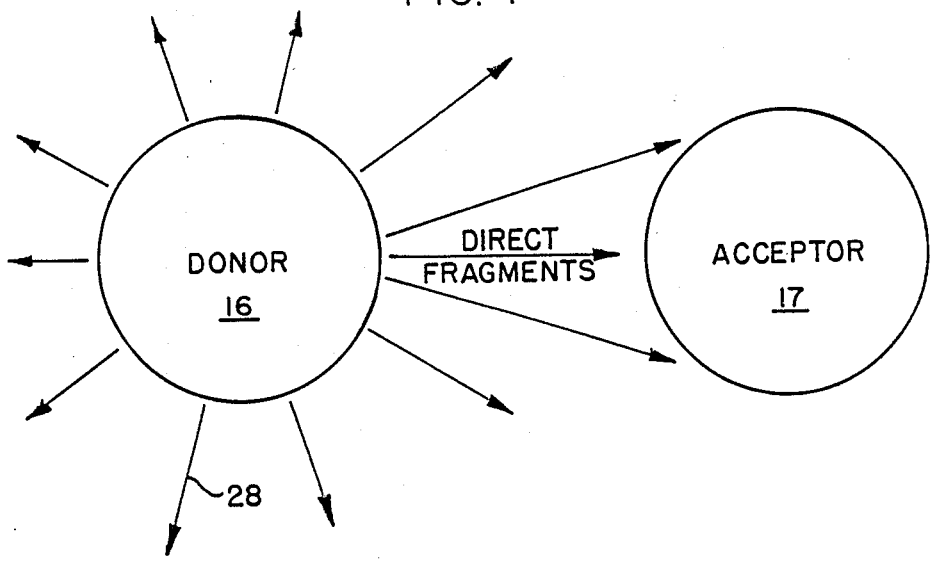
FIG. 1 is an illustration of a sympathetic detonation, being induced into an acceptor bomb by the detonation of a donor bomb.

FIG. 1 is an illustration of a sympathetic detonation as depicted in U.S. Pat. No. 4,286,708 issued to Porzel on Sept. 1, 1981. As depicted the donor bomb 16 engenders detonation in an acceptor bomb 16 when direct fragments are projected into it.

When a high explosive bomb is detonated, the charge is transformed in about 0.0002 seconds to a very hot gas. This gas momentarily occupies only the volume of the solid explosive, and consequently develops enormous pressure (about 100 tons per square inches for TNT). The gases expand violently in all directions under influence of this pressure, shattering or displacing surrounding material, generating shock and pressure waves, and projecting fragments of the shattered case at high velocity. Should a bomb be caused to be initiated in a storage configuration on a steel pallet, shock and pressure waves and projected fragments would impinge on the adjacent bomb or bombs with resulting sympathetic detonation of these items.

Porzel recognized that sympathetic detonation may be caused by direct shock, fragment impact, cook off, translational impact or radiation (laser, X-rays, etc.). The solution of Porzel was to completely encapsulate each stored bomb within a blast suppressive shielding with thick walls which attenuate the shock of an explosion. A similar solution is provided in U.S. Pat No. 4,484,678 issued to Walker et al, in which munitions are housed in rack with a sufficient diverter between adjacent explosives to prevent sympathetic detonation.

Figure 2:
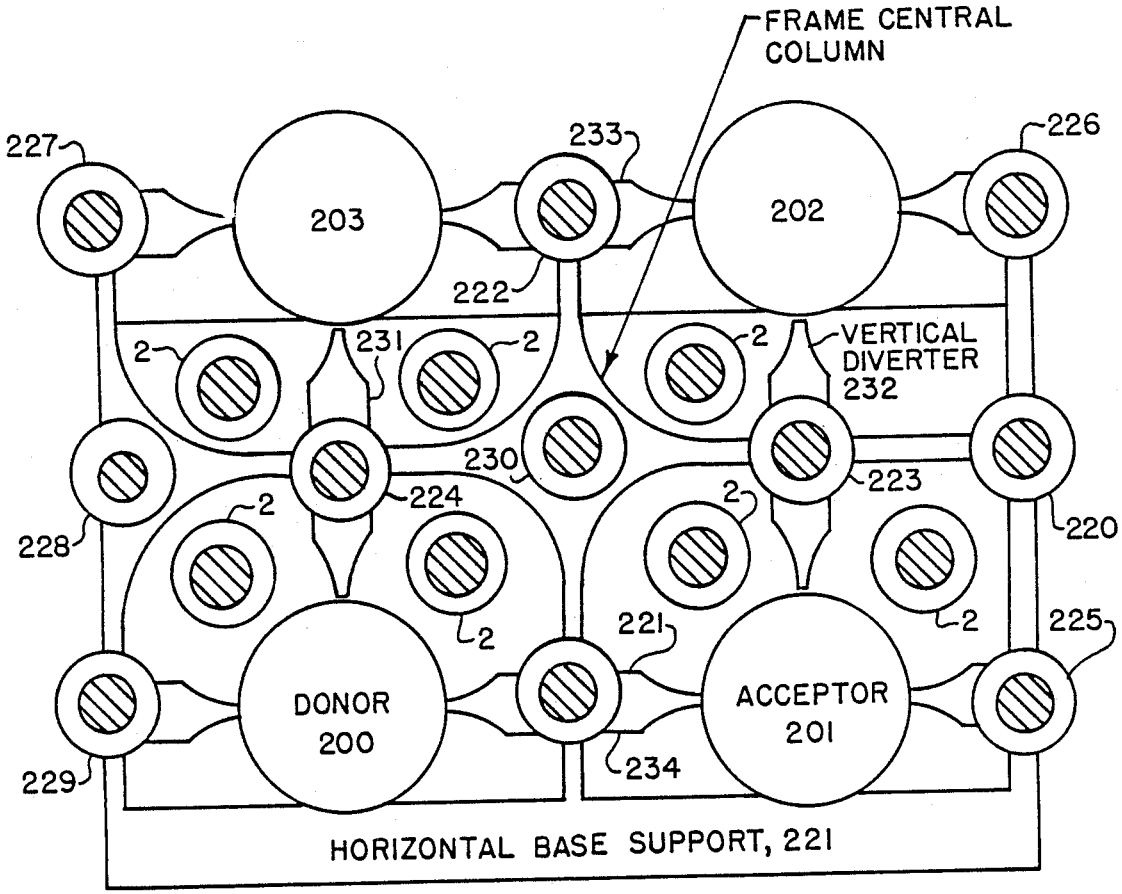
FIG. 2 is an illustration of the preferred embodiment of the present invention.

The reader's attention is now directed towards FIG. 2, which is a side view of an example of the bomb rack diverter assembly of the present invention. The system of FIG. 2 protects an adjacent acceptor bombs 201–203 from sympathetic detonation in response to the detonation of a donor bomb 200. The bomb pallet design of FIG. 2 includes: a horizontal base support 221, and a bomb rack diverter assembly which includes a frame which holds the horizontal diverter elements 233 and 234, and the vertical diverter elements 231 and 232 in place. Additionally, the diverter assembly includes a plurality of enclosed tubes numbered 2, and 220–230, which are interposed between the adjacent bombs. All of the enclosed tubes 2 and 220–230 in FIG. 2 run the full length of the adjacent bombs and are filled with fire suppressant chemical extinguishing agents to suppress sympathetic detonations in the manner discussed below.

All of the enclosed tubes in the bomb rack diverter assembly of FIG. 2 are filled with fire suppressant chemical extinguishing agents. The detonation of the donor bomb 200 will have the initial effect of rupturing adjacent enclosed tubes to release these quenching agents so that they immediately and automatically reduce the fire hazard. These chemical extinguishing agents can be selected from a group that includes $NaHCO_3$, water, sodium bicarbonate, and halon vaporizing liquid.

Upon detonation of the donor bomb 200, the adjacent enclosed tubes are ruptured and the fire suppressant agents are driven into the expanding gas field of the detonation. When this occurs, the generation of steam and evolution of carbon dioxide dilutes the oxygen and changes the chemical composition of the original gas field, slows the gas velocity thus reducing the pressure on adjacent bombs and reduces the velocity of any bomb fragments. The spreading of the agents also reduces the temperature of any exposed explosive to a point where combustible vapors are no longer evolved and activation energy is lowered to the extent that no activated atoms or free radicals are produced. The enclosed tubes may be composed of ceramic, glass, plastic and similar substances which will rupture and release the fire quenching agents upon the detonation of a donor bomb.

The bomb rack diverter assembly of FIG. 2 may be composed or any of the materials conventionally used in the storage of munitions, such as molded concrete and steel. It should be noted that although several types of material with properties of low shock velocity have been used to suppress sympathetic detonation, one of the most effective materials has been acrylic plastic (lucite). It would appear from test results that the material retards the velocity of case fragments, acts as a diverter, and suppresses shock and pressure waves. Glass or boron fibers can be added to the plastic used to enhance the mechanical properties of the plastic material, and provide the structural integrity to support heavy bombs.

The selection of an acrylic plastic was made after the identification of the mechanical processes which transport energy from the donor bomb to the acceptor bomb. These processes are characterized as (a) flyer plate mode, (b) pure shock transmission, (c) mechanical distortion, and (d) fragment penetration. The primary difference between (a) and (d) is the distance between the items. While air is not an efficient medium for shock propagation, it does allow large energy transfers by means of the flyer plate mode. Thus, the flyer plate mode would be characterized as very efficient when compared to shock transmission. Peak shock pressure transmission for rounds in contact is about 60 Kbar, while rounds separated by an air space transmit almost three times the peak pressure due to impact of the donor case wall against the acceptor.

Figure 3:
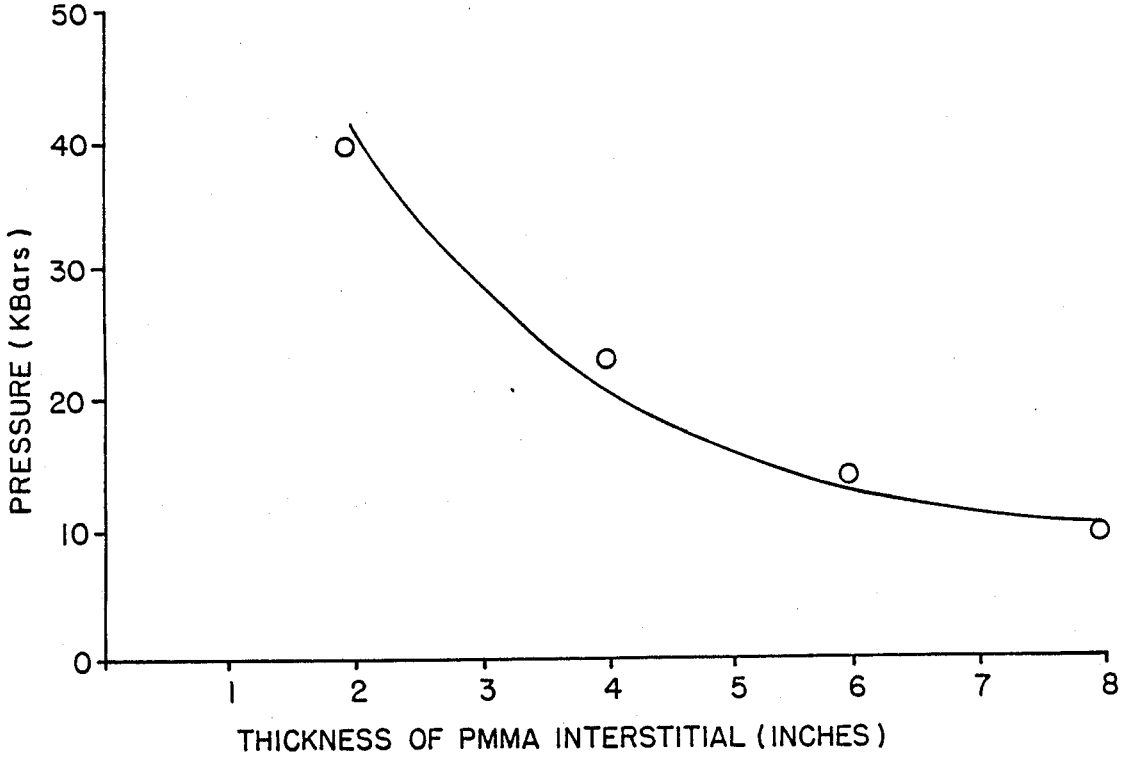
FIG. 3 is a chart of pressures transmitted through diverters composed of acrylic plastic of different widths.

To determine the appropriate width of the buffer, shock sensitivity tests were performed with the detonation of donors, and Plexiglas (R) of varying thicknesses was used to control the shock strength transmitted into the acceptor. FIG. 3 is a chart of the pressures of Kbars transmitted to acceptors in varied widths of acrylic plastic buffers.

The significance of these tests is that they indicate the amount of separation required to protect bombs in the MK-80 series. For example, MK-80 bombs loaded with tritonal, as an insensitive high explosive, have a threshold of between 12 and 14 Kbar. Another candidate for insensitive high explosive bombs of the MK-80 series is called EAK. EAK consists of 46% ethylenediamine dinitrate, 46% ammonium nitrate, and 8% potassium nitrate. EAK is slightly less sensitive to shock than tritinol and has a published threshold of between 30 and 40 Kbar. Therefore, the selection of the diverter width is made by choosing a thickness which reduces the impact pressures to a level which is too low to induce detonation. Therefore the width of all the diverters (both vertical and horizontal) in the system of FIG. 2 is determined by the required thickness necessary to protect the acceptor bombs 201–203 from transmitted shock. For example, if an acrylic plastic is selected as the material for the diverter, the chart of FIG. 3 translates pressure protection into a commensurate width of the diverter between adjacent bombs.

Figure 4:
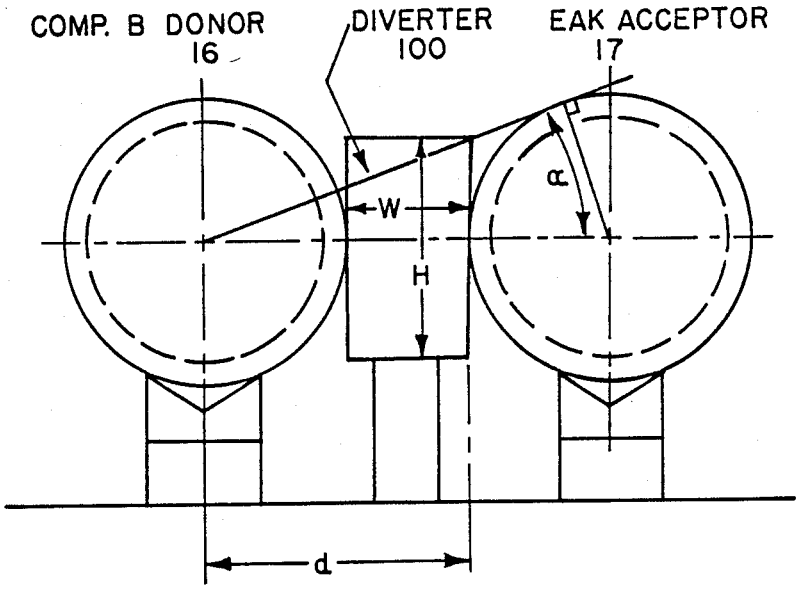
FIG. 4 is an illustration of the test set-up used to determine the width (W) and height (H) for the dimensions of the diverters used in the system of FIG. 2.

The reader's attention is now directed towards FIG. 4, which depicts a donor bomb 16 separated from an acceptor bomb 17 by a diverter 100. The diverter 100 of FIG. 4 is a model which provides the dimensions required of both the vertical and the horizontal diverters using in the system of FIG. 2. In FIG. 4, the width (W) of the diverter 100 is determined by the required width necessary to protect the acceptor bomb from transmitted shock. This required thickness is in turn determined by two factors: first, the pressure threshold which the acceptor can withstand before sympathetic detonation; and second, the width is one (depending upon the material selected) which reduces the transmitted shock to levels below that of the threshold. When acrylic plastic is used as the diverter to protect the MK-80 series of bombs, the width of the vertical and horizontal diverters can be determined by FIG. 3. Since the shock threshold of EAK is between 30 and 40 Kbar, the width of the vertical and horizontal diverters should be greater than three inches acrylic plastic. FIG. 3 allows the users of this invention to make an informed choice on the width of the diverters since it indicates the attenuation that transmitted shock experiences as it propagates along the diverter.

Alternatives to acrylic, including steel, wood, ceramic, nylon, aluminum and lead have been tested for their abilities to attenuate shock and are candidates that may be considered for buffers and diverters. However, eliminating the cost factor, the optimum material for a buffer or diverter is acrylic plastic.

Note that the system of FIG. 2 is intended to serve as just single example of the present invention. Variations to the system of FIG. 2 could include the use of a diverter that completely surrounds adjacent munitions, but holds the tubes of chemical extinguishing agents in close proximity with the explosive devices. However, the system of FIG. 2 is believed to be the preferred embodiment of the present invention, for the reasons discussed below.

While adjacent bombs can be completely encompassed by an intervening buffer to protect an acceptor bomb from fragments with a donor, complete circumscription of adjacent bombs is not necessary. As shown in FIG. 4, the height (H) of the diverter must be sufficient to shield the silhouette of the second bomb 17 from the first bomb 16. The value of this height is determined by simple geometry and is given by:

$$H \geqq 2(d \cdot \mathrm{Tan}^{-1}\alpha)$$

where:

H equals the measure of height of the diverter which is sufficient to shield the silhouette of the second bomb 17 from the first bomb 16;

W equals a measure of the horizontal width of the diverter between the first and second bomb;

R equals the radius of each of the bombs;

d equals R+W; and $\alpha$ is an angle given by $\alpha = \mathrm{Sin}^{-1}(R/2R+W)$ As shown in FIG. 1, there is an assumption that upon detonation, the forces and fragments from the explosion expand radially around the circumference of the bomb. Therefore, the geometry of the diverter must present a surface area to the donor bomb which shields the silhouette of the acceptor bomb from the radial dispersion of fragments. This surface area, as depicted in FIG. 4, is one that completely fills the cone made by the set of vectors between the center of the donor bomb, to their tangential intersection with the spherical silhouette of the acceptor bomb.

FIG. 4 defines this set of vectors as having an angle of between themselves and plane which intersects the centers of the two bombs. The angle $\alpha$ being defined as:

$$\alpha = \sin^{-1}\frac{R}{2R + W}$$

R=the radius of each or the bombs; and

W=the width separating the two bombs.

Returning to the system of FIG. 2, the horizontal and vertical diverters are each depicted as a wedge-shaped I-beam with sides that touch and conform to the surfaces of the two bombs and which run the lengths of the bombs. Although the sides of the diverters are depicted as wedge-shaped, the principals that govern the diverter geometry are as discussed above: the over-all width (W) of the diverter must be of sufficient thickness to attenuate shock below the threshold of sympathetic detonation, and the height (H) must be *at least* sufficient to shield the silhouette of adjacent bombs from each other. Of course the vertical and horizontal diverters may also be the rectangular boxes depicted in FIG. 4 but the width and height of the diverters are determined as described above.

The present invention has been designed particularly for the protection of insensitive high explosive (IHE) bombs from sympathetic detonation, and to replace the existing steel structures (pallets) that are currently used to support these bombs in storage. This invention reduces the potential of explosive cookoff when a bomb positioned on a plastic pallet is detonated and the adjacent bomb cases are ruptured exposing the explosive fill. The addition of the chemical fire extinguishing features help to dilute the high pressure gas cloud created by the detonating bomb to a point where combustion is severely retarded. This action also cools the exposed explosive, and activation energy is lowered to the extent that no activated atoms or free radicals are produced. The addition of the chemical fire extinguishing agents also interrupts the flame chemistry of the chain reaction of combustion by injecting compounds capable of quenching free radical production.

The chemical fire suppressant agent in the enclosed tubes can be selected from any of the quenching agents used in conventional fire extinguishers. These include: $NaHCO_3$, sodium bicarbonate, water, and halon vaporizing by the explosion of the a donor bomb, the results can include the generation of steam and carbon dioxide as these agents are automatically applied to the fire in the manner of a chemical, dry or wet, fire extinguisher.

When the invention is used for the storage of high explosives, the disbursement of the fluid or powdered dry chemical agents into the very hot detonation gas field slows the detonation products (gases) produced by an exploding bomb, reduces the coupling effect on the adjacent bombs and acts as a fire suppressant. The buffer diverter structure of the structural elements together with fluid or powder (flame suppressant agents) which assist in reflecting bomb fragments, has the effect of attenuating peak pressures generated by a donor bomb and reduces the heat energy from the detonation of a donor bomb. This invention has the potential of being used wherever large ordinance are stored.

While the invention has been described in its presently preferred embodiment, it is understood that the words which have been used are words of description rather than words of limitation and that changes within the purview of the appended claims may be made without departing from the scope and spirit of the invention in its broader aspects.

What is claimed is:

1. A bomb storage pallet for suppressing sympathetic detonation of an acceptor bomb in an event of a detonation of an adjacent donor bomb by shielding the acceptor bomb from fragments and shock to a level below a pressure threshold at which the acceptor bomb would be induced into a sympathetic detonation, said bomb storage pallet also containing fire suppressant chemical extinguishing agents to reduce a fire hazard, in the event of the detonation of the donor bomb, said bomb storage pallet comprising:

a first horizontal base which supports a first and a second bomb which are lying horizontally and which are lying parallel with each other;

a first horizontal diverter which abuts and rests between the first and second bombs along their entire lengths, said first horizontal diverter having a sufficient width to reduce any shock propagated through it by a detonation of either bomb below a pressure threshold at which the first and second bomb would experience a sympathetic detonation, said first diverter having a sufficient height to shield each first and second bomb's silhouettes from fragments from a detonation of either bomb;

a frame which is fixed to said first horizontal base and which holds said first horizontal diverter in place; and a plurality of tubes which are filled with said fire suppressant chemical extinguishing agents, said plurality of tubes including at least one auxiliary tube which is supported by said frame between said first and second bombs along their entire length and which ruptures upon a detonation of a bomb to release said fire suppressant chemical extinguishing agents and reduce the fire hazard of the detonation to help prevent said sympathetic detonation.

2. A bomb storage pallet, as defined in claim 1, where in said plurality of tubes are filled with fire quenching agents selected from group which comprises:

$NaHCO_3$;

sodium bicarbonate;

water; and halon vaporizing liquid agents.

3. A bomb storage pallet as described in claim 2, wherein said first horizontal diverter has central aperture which contains one of said plurality of tubes.

4. A bomb storage pallet as defined in claim 2, wherein said frame contains a first and second outer wall which are respectively beside said first and second bombs along their entire lengths, said first and second outer walls each containing one of said plurality of tubes filled with said fire suppressant chemical agents to reduce the fire hazard in the event of a detonation.

5. A bomb storage pallet, as defined in claim 4, wherein said frame contains a second horizontal base which is fixed above said first horizontal base by said outer walls and a central column, said second horizontal base supporting a third and fourth bomb which are lying horizontally parallel with each other and parallel with said first and second bombs, and wherein said bomb storage pallet includes:

a first and second vertical diverter which are held in place by said frame and which respectively abut and rest between said first and said third bombs and between said second and said fourth bombs along their entire lengths, said first and second vertical diverter each having a sufficient width between their respective bombs to reduce any shock propagated through it below a pressure threshold at which their respective bombs would experience a sympathetic detonation, said first and second vertical diverter having a sufficient thickness to shield their respective bomb's silhouettes from fragments from a detonation of either bomb; and a second horizontal diverter which has dimensions equalling those of said first horizontal diverter, said second horizontal diverter being held in place by said frame so that it abuts and rests between said third and fourth bombs along their entire lengths to shield them from fragments from a detonation of either bomb.

6. A bomb storage pallet, as defined in claim 5, in which said second horizontal diverter has a hollow central aperture and contains one of said plurality of tubes containing fire quenching agents.

7. A bomb storage pallet, as defined in claim 6, in which said first and second vertical diverters each have hollow central apertures, and each contain one of said plurality of tubes containing fire quenching agents.

8. A bomb storage pallet, as defined in claim 7 wherein said sufficient height of said first and second horizontal diverters is given by $H=2(d\cdot \mathrm{Tan}^{-1}\alpha)$ wherein:

H equals said sufficient height of said first and second horizontal diverter to shield said second bomb from said first bomb;

d equals the horizontal distance of said sufficient thickness from said first bomb's center; and $\alpha$ is an angle given by:

$$\alpha=\mathrm{SIN}^{-}(R/2R+W)$$

where

R equals the second bomb's radius; and

W equals a measure of horizontal distance between the first bomb and the second bomb.

* * * * *